US007303104B2

(12) United States Patent
Huang

(10) Patent No.: US 7,303,104 B2
(45) Date of Patent: Dec. 4, 2007

(54) POWER GENERATOR OF NAIL DRIVE

(76) Inventor: Wen-Sheng Huang, 235 Chung-Ho Box 8-24 Taipei, Taichung City (TW)

( * ) Notice: Subject to any disclaimer, the term of this patent is extended or adjusted under 35 U.S.C. 154(b) by 0 days.

(21) Appl. No.: 11/368,010

(22) Filed: Mar. 6, 2006

(65) Prior Publication Data

US 2007/0215667 A1 Sep. 20, 2007

(51) Int. Cl.
*B25C 1/08* (2006.01)

(52) U.S. Cl. ..... 227/11; 227/10; 227/131; 227/156

(58) Field of Classification Search ..... 227/11, 227/10, 9, 15, 6, 131; 361/268, 270; 123/601, 123/604, 605, 621, 154, 193.4
See application file for complete search history.

(56) References Cited

U.S. PATENT DOCUMENTS 3,552,627 A * 1/1971 Moreno ..... 227/121
3,560,693 A * 2/1971 Morin, Jr. ..... 219/611
3,651,740 A * 3/1972 Perkins ..... 91/417 A
3,924,789 A * 12/1975 Avery ..... 227/131
3,967,771 A * 7/1976 Smith ..... 227/10
4,000,729 A * 1/1977 Clark, Jr. ..... 123/640
4,172,439 A * 10/1979 Pasbrig ..... 123/634
4,293,088 A * 10/1981 Barrett et al. ..... 227/131
5,191,861 A * 3/1993 Kellerman et al. ..... 123/46 SC
5,732,870 A * 3/1998 Moorman et al. ..... 227/130
5,918,788 A * 7/1999 Moorman et al. ..... 227/8
6,644,825 B2 * 11/2003 Lin ..... 362/119
6,693,505 B2 * 2/2004 Bock ..... 336/69

* cited by examiner

*Primary Examiner*—Brian D. Nash

(57) ABSTRACT

A power generator of a nail drive comprises a body; a cylinder in the body; a plug in the cylinder; a plug in the cylinder; and a magnetic element on the plug. The movement of the plug will drive the magnetic element to pass through the induction coil so that the induction coil generates current. The induction coil is connected to a battery device for storing the current power from the induction coil. The nail drive is installed with an ignition device, a fan or an illumination device; and the battery device supplies power to the ignition device for ignition. A charger is connected to the battery device. The nail drive is a pneumatic driving nail driver or a gas driving nail driver.

6 Claims, 3 Drawing Sheets

POWER GENERATOR OF NAIL DRIVE

FIELD OF THE INVENTION

The present invention relates to nail drivers, and in particular to a power generating nail driver, in that an induction coil and a magnetic element are equipped to generate power and the power is stored in a battery device so as to supply power to the illumination device, fan and ignition device of the nail driver. Thus it is unnecessary to update the battery.

BACKGROUND OF THE INVENTION

Nail drivers are frequently used tools in working. However some pneumatic or gas driving nail drivers need power to drive the illumination device, fan and ignition device of the nail driver.

In the prior art nail driver, a battery is used to power supply to the ignition device, illumination device and fan of the nail driver. As power of the battery is used up. A new one is used to update the old one. Thus, uses are necessary to update the battery frequently. Time is consumed and cost is high.

SUMMARY OF THE INVENTION

Accordingly, the primary object of the present invention is to provide a power generating nail driver, in that an induction coil and a magnetic element are equipped to generate power and the power is stored in a battery device so as to supply power to the illumination device, fan and ignition device of the nail driver. Thus it is unnecessary to update the battery.

To achieve above objects, the present invention provides a power generator of a nail drive which comprises a body; a cylinder in the body; an plug in the cylinder; a plug in the cylinder; a magnetic element on the plug. The movement of the plug will drive the magnetic element to pass through the induction coil so that the induction coil generate current. The induction coil is connected to a battery device for storing the current power from the induction coil. The nail drive is installed with an ignition device, a fan or an illumination device; and the battery device supplies power to the ignition device for ignition. A charger is connected to the battery device. The nail drive is a pneumatic driving nail driver or a gas driving nail driver.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
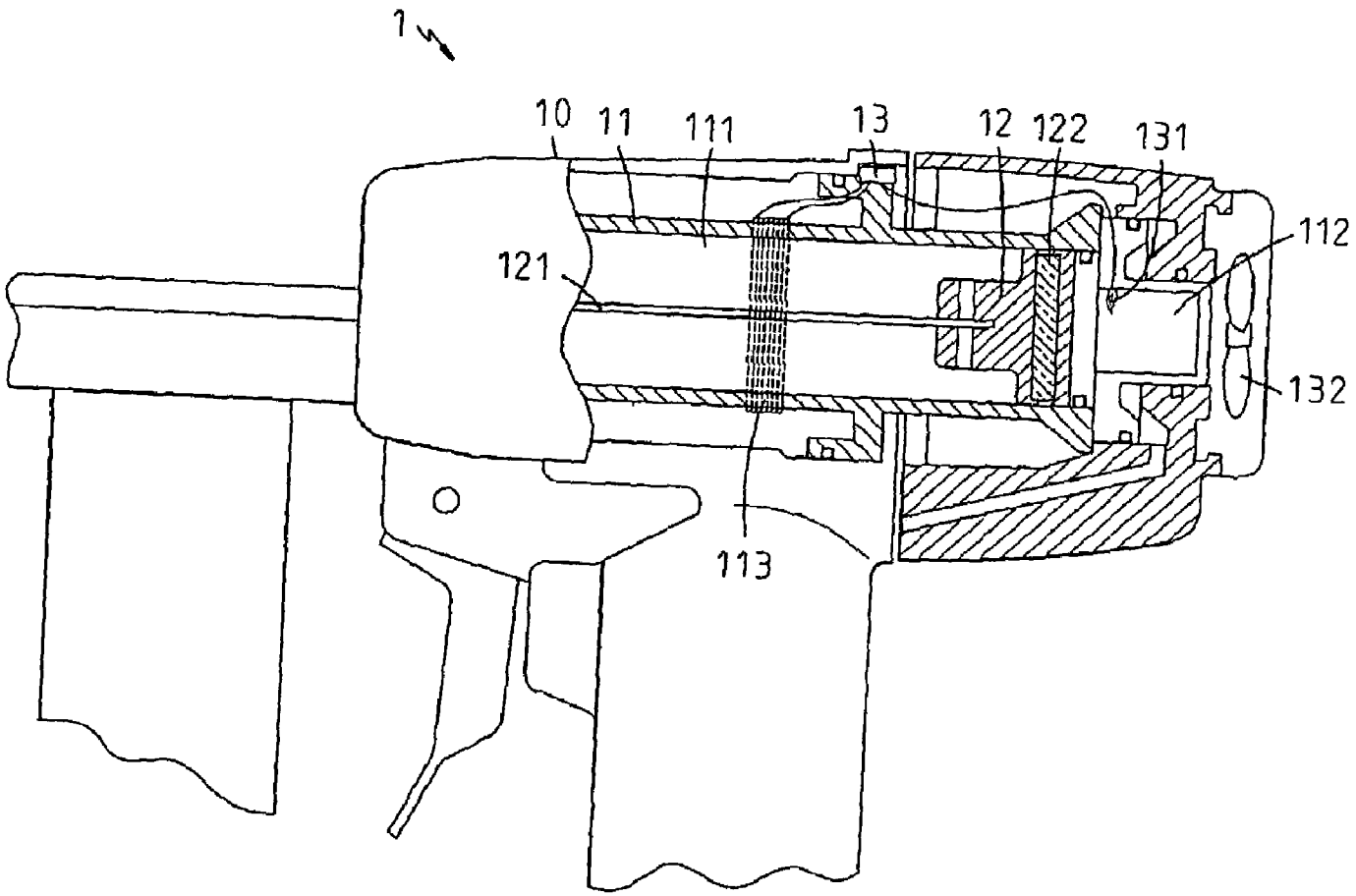
FIG. 1 is a schematic cross sectional view about the power generator of a nail drive of the present invention.
Figure 2:
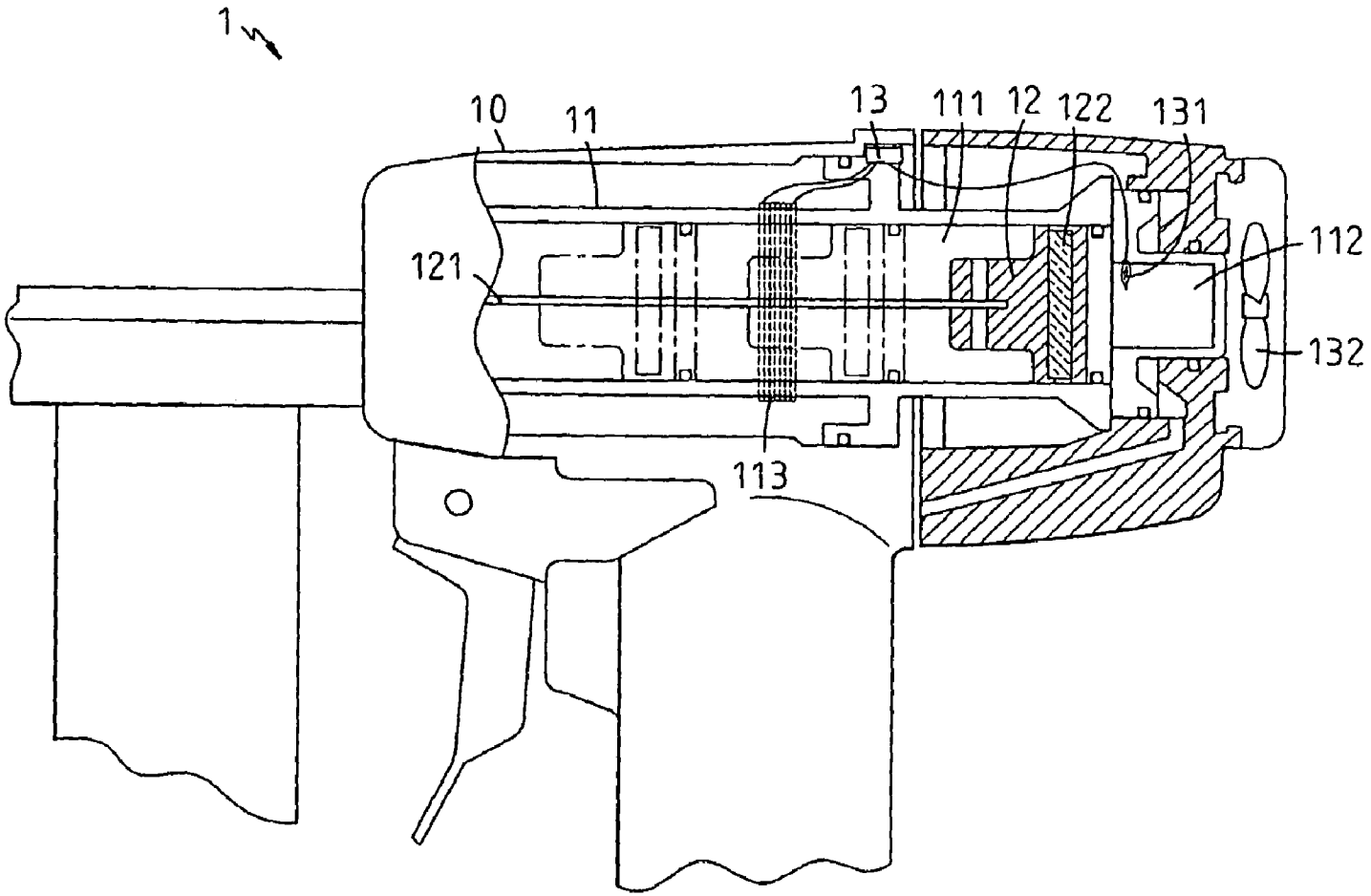
FIG. 2 shows the operation of the power generator of a nail drive of the present invention.

Referring to FIGS. 1 to 2, the power generator of a nail driver of the present invention is illustrated. In this embodiment, the nail driver has a body 1 which is a gas power driving device. The gag power driving is known in the art and thus the details will not be described herein.

The present invention has the following elements.

A head 10 has a cylinder 11 at an axial direction thereof. The cylinder 11 has an air chamber 111. A plug 12 is installed in the air chamber 111. A combustion chamber 112 is installed at one end of the cylinder 11, also at one end of the plug. When gas is injected into the combustion chamber 112 and then is ignited, an impact force is generated so as to impact the plug 12 to collide the firing pin 121 to strike a nail.

An induction coil 113 is installed in the air chamber 111 of the cylinder 11. The induction coil 113 is connected to a battery device 13. A magnetic element 122 is installed on the plug 12. A surface of the magnetic element 122 is near the air chamber 111 of the cylinder 11. As shown in FIG. 2, when the plug 12 displaces in the cylinder 11, the magnetic element 122 passes through the induction coil 113 so that the magnetic flux of the induction coil 113 changes. Thus the induction coil 113 has induction currents. Thereby the battery device 13 will have power energy and store the power energy. The power stored in the battery device 13 is supplied to an ignition device 131 in the combustion chamber 112 or a dissipating fan 132. Thus the battery device 13 is unnecessary to be updated.

Furthermore, in the present invention, other than charging power to the induction coil 113, a dedicated charger can be used to charge power to the battery device 13.

Figure 3:
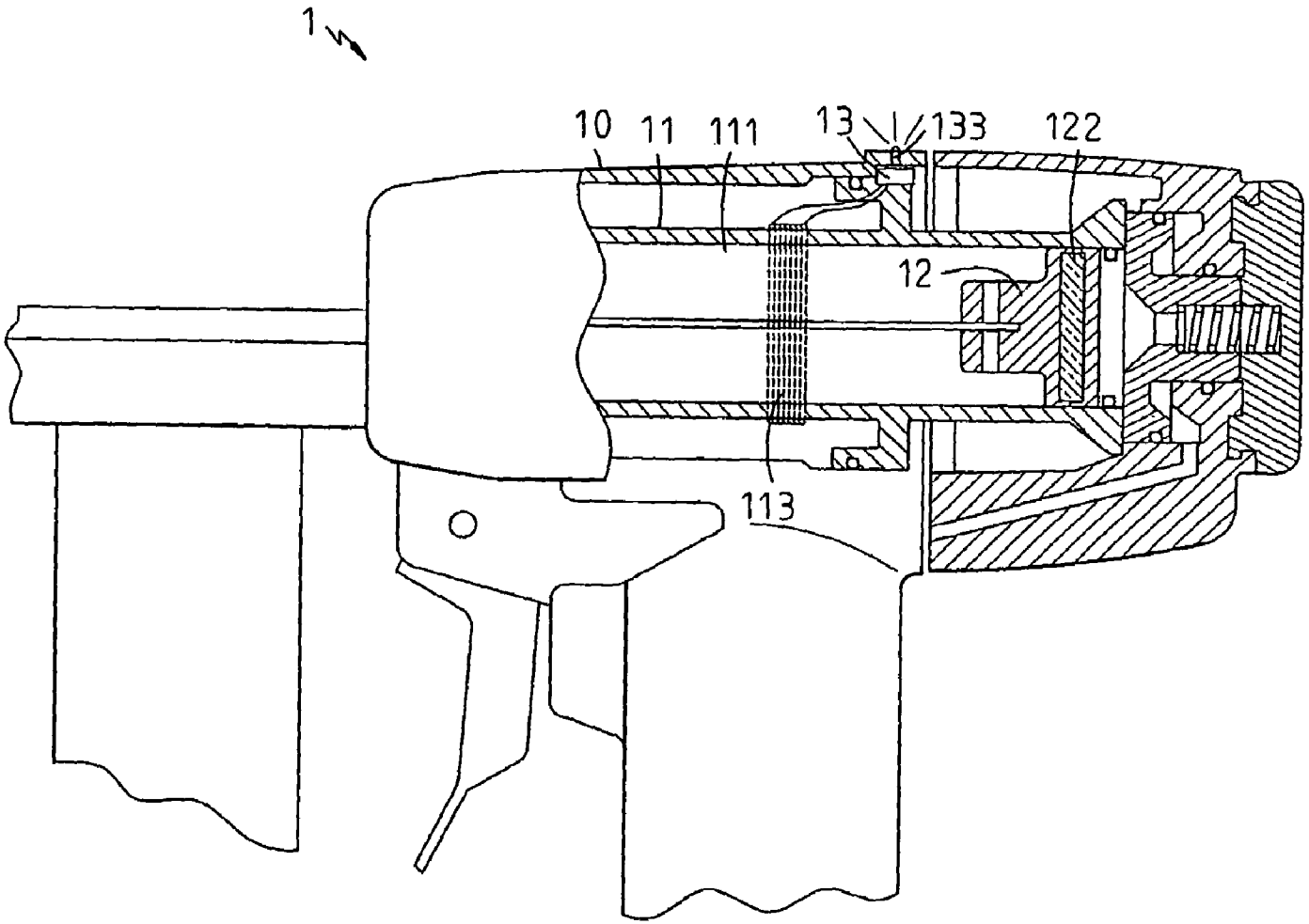
FIG. 3 is a schematic cross sectional view of the second embodiment of the present invention.

With reference to FIG. 3, the second embodiment of the present invention is illustrated. Those identical to the first embodiment will not be described. Only those differences are described.

In this embodiment, the body 1 is a pneumatic nail driver, the body 1 of the present invention is connected to an air compressor (not shown). High pressure air from the air compressor serves to push the plug 12 to moves. Similarly, the magnetic element 122 of the plug 12 and the induction coil 113 of the cylinder 11 are used to generate current so that power is generated. Moreover other than as the power source of the induction coil 113, the battery device 13 can supply power to an illuminator on the body 1, as shown in FIG. 3. Power is supplied from the battery device 13. Thus, the illuminator will light up.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A power generator of a nail driver comprising:

a nail body having a head;

a cylinder in the head of the body;

a plug in the cylinder;

a magnetic element on the plug;

wherein a movement of the plug drives the magnetic element to pass through an induction coil so that the induction coil generates a current; and wherein the induction coil is connected to a battery device for storing the current power from the induction coil.

2. The power generator of a nail driver as claimed in claim 1, wherein the nail driver is installed with an ignition device; and the battery device supplies power to the ignition device for ignition.

3. The power generator of a nail driver as claimed in claim 1, wherein the nail driver is installed with a fan; the battery device supplies power to the fan for operating the fan.

4. The power generator of a nail driver as claimed in claim 1, wherein the nail driver is installed with an illumination device; the battery device supplies power to the illumination device.

5. The power generator of a nail driver drive as claimed in claim 1, wherein a charger is connected to the battery device.

6. The power generator of a nail driver as claimed in claim 1, wherein the nail driver is a pneumatic driving nail driver.

* * * * *